US007479972B2

(12) United States Patent
Takai

(10) Patent No.: US 7,479,972 B2
(45) Date of Patent: Jan. 20, 2009

(54) DISPLAY DEVICE

(75) Inventor: Kazumasa Takai, Kakamigahara (JP)

(73) Assignee: Sanyo Electric Co., Ltd., Osaka (JP)

( * ) Notice: Subject to any disclaimer, the term of this patent is extended or adjusted under 35 U.S.C. 154(b) by 454 days.

(21) Appl. No.: 11/104,676

(22) Filed: Apr. 13, 2005

(65) Prior Publication Data

US 2005/0231450 A1 Oct. 20, 2005

(30) Foreign Application Priority Data

Apr. 16, 2004 (JP) ..... 2004-121204

(51) Int. Cl.
*G09G 3/36* (2006.01)

(52) U.S. Cl. ..... 345/690; 345/63; 345/76; 345/77; 345/204; 345/691; 345/692

(58) Field of Classification Search ..... 345/63, 345/76, 77, 82, 147, 690–693
See application file for complete search history.

(56) References Cited

U.S. PATENT DOCUMENTS 4,796,980 A * 1/1989 Kaneko et al. ..... 349/85
4,818,078 A * 4/1989 Mouri et al. ..... 345/89
5,006,865 A * 4/1991 Kuroiwa ..... 347/183
5,973,719 A * 10/1999 Araki et al. ..... 347/253
6,144,364 A * 11/2000 Otobe et al. ..... 345/691
6,646,654 B2 * 11/2003 Takagi ..... 345/690
7,184,034 B2 * 2/2007 Kimura ..... 345/205
7,187,392 B2 * 3/2007 Ito ..... 345/690
2001/0048420 A1 * 12/2001 Yamamoto et al. ..... 345/89
2004/0233227 A1 * 11/2004 Toriumi et al. ..... 345/690
2004/0233229 A1 * 11/2004 Kimura ..... 345/690
2006/0066592 A1 * 3/2006 De Greef ..... 345/204

FOREIGN PATENT DOCUMENTS

JP 10-312173 11/1998
JP 2002-278478 9/2002
JP 2003-241711 8/2003

* cited by examiner

*Primary Examiner*—Bipin Shalwala
*Assistant Examiner*—Vince E Kovalick
(74) *Attorney, Agent, or Firm*—Morrison & Foerster LLP

(57) ABSTRACT

In a display device performing multiple gray level display using a sub-field drive method, an operation rate of a scan driver and a data driver is reduced and power consumption in the circuits are reduced. When $2^8$ levels of gray level display is performed with 8 bits of video data, one field is equally divided by 8 into eight sub-fields to generate a first sub-field SF0 through an eighth sub-field SF7. Each of the sub-fields SF0 through SF7 has an equal length of sub-field period to each other. And a line-sequential addressing is adopted in addressing pixels so that each line of video data is written-in collectively. Addressing operation of the pixels and light emitting operation of the pixels are performed in parallel. Each of addressing periods AP0 through AP7 in each of the sub-fields is approximately equal to the sub-field period, that is a period of one field divided by 8.

16 Claims, 11 Drawing Sheets

SF0～SF3 : sub-field period
AP0～AP3 : addressing period
LP0～LP3 : light emitting period FIG.5A corelation between pulse signal and sub-field when duty ≒ 50%
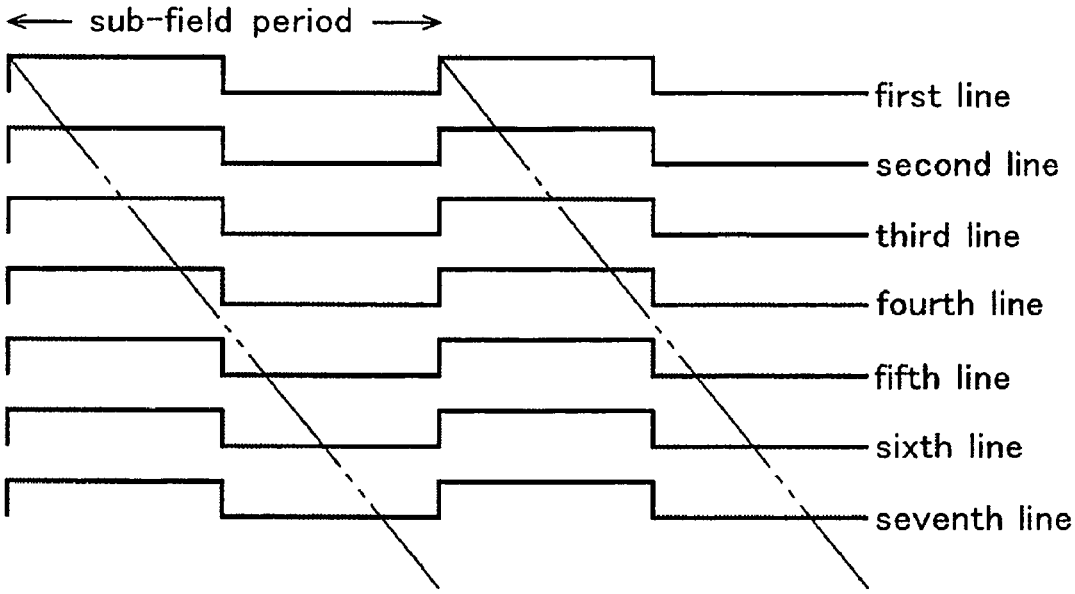
FIG.5B corelation between pulse signal and sub-field when duty ≒ 17%
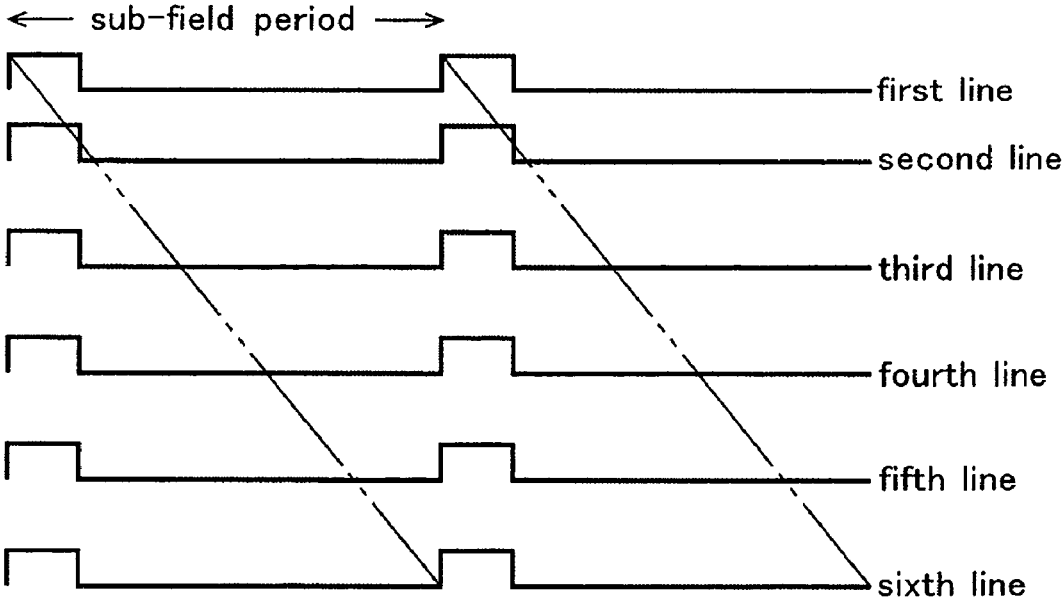

FIG.7
| sub-field | SF1 | SF2 | SF3 | SF4 | SF5 | SF6 | SF7 |
|---|---|---|---|---|---|---|---|
| in the case of geometric progression of 2 | 1 | 2 | 4 | 8 | 16 | 32 | |
| in the case of non-geometric progression of 2 | 1 | 2 | 4 | 8 | 16 | 16 | 16 |
FIG.8A
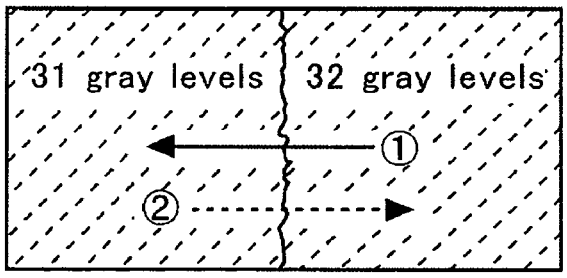
FIG.8B
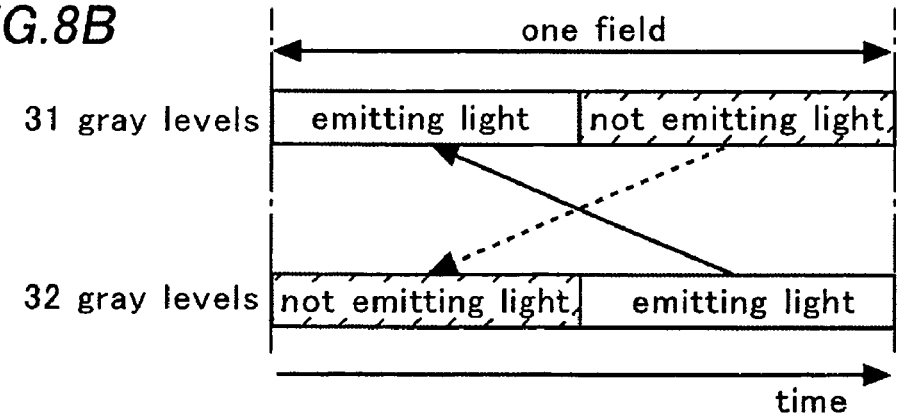

DISPLAY DEVICE

CROSS-REFERENCE OF THE INVENTION

This invention is based on Japanese Patent Application No. 2004-121204, the content of which is incorporated herein by reference in its entirety.

BACKGROUND OF THE INVENTION

1. Field of the Invention

This invention relates to a display device, specifically to a display device performing multiple gray level display corresponding to multi-bit digital video data.

2. Description of the Related Art

Organic EL device using an organic electroluminescence elements (hereafter referred to as organic EL element) have been receiving attention in recent years as a display device which would replace a CRT and an LCD. An active matrix type organic EL display device having a thin film transistor (hereafter referred to as a TFT) that serves as a driver transistor supplying a drive current to an organic EL element in each of pixels has been developed.

In a basic structure of the active matrix type organic EL display device, each pixel 52 includes an organic EL element 50 made of a part of an organic luminescent layer, a driver transistor TR2 that controls a current flow to the organic EL element 50, a write transistor TR1 that is turned on when a scanning voltage SCAN is applied to a scanning electrode and a capacitor C that stores electric charges when a data voltage DATA from a data electrode is applied. An output of the capacitor C is applied to a gate of the driver transistor TR2, as shown in FIG. 11.

First, the scanning voltage SCAN is successively applied to each of the scanning electrodes to turn on a plurality of the write transistors TR1 connected to a common scanning electrode. A data voltage (input signal) is applied to each of the data electrodes in synchronization with the scanning. Since the write transistor TR1 is turned on at that time, the data voltage DATA is stored in the capacitor C.

An amount of electric charges stored in the capacitor C by the data voltage determines a status of operation of the driver transistor TR2. When the driver transistor TR2 is put into an active status, for example, a current corresponding to the data voltage DATA flows to the organic EL element 50 through the driver transistor TR2. As a result, the organic EL element 50 emits light with brightness corresponding to the data voltage DATA. This light emitting status continues for a vertical scanning period.

A method to drive the organic EL element 50 to a brightness corresponding to the data voltage by proving the organic EL element 50 with the current corresponding to the data voltage as described above is called an analog drive method. On the other hand, an organic EL display device using a digital drive method with which multiple gray level display is implemented by providing the organic EL element 50 with a pulse current having a duty corresponding to the data voltage is proposed.

In the organic EL display device using the digital drive method, one field (or one frame) that is a period to display one screen of picture is divided into a plurality (N) of sub-fields (or sub-frames) SF, and each of the sub-field SF is composed of addressing periods (scanning periods) AP during which the data voltages are written into all of the pixels and light emitting periods LP during which the organic EL element 50 in each of the pixels emits light corresponding to the written data voltage, as shown in FIG. 13.

The light emitting periods LP included in a field vary in length to have lengths of $2^n$ (n=0, 1, 2, - - -,N−1), while all the addressing periods AP in a field have the same length. In an example (N=8) shown in FIG. 13, eight sub-fields SF0-SF7 are included in one field. All of eight addressing periods AP0-AP7 have the same length. Each of eight light emitting periods LP0-LP7 is set to each of lengths 1, 2, 4, 8, 16, 32, 64 and 128, so that a display of 256 gray levels is available with turning on and off during each of the light emitting periods.

In a sub-field drive method described above, binary data of a sub-field SF is written into a capacitor C by applying a scanning voltage to a write transistor TR1 forming each of pixels 52 during a scanning period in each of the sub-fields SF, and a driver transistor TR2 provides an organic EL element 50 with a current corresponding to the binary data later in a light emitting period, as shown in FIG. 12. Starting time and ending time of light emitting period of each of the organic EL elements 50 in each of the sub-fields can be aligned by providing a current supply line to a driver transistor TR2 forming each of pixels 53 with a on/off switch SW in the sub-field drive method, as shown in FIG. 12. Related technical information is disclosed in Japanese Patent Publication Nos. 2003-241711, 2002-27847 and H10-312173.

When $2^n$ levels of gray level display is performed with n bits of video data using the sub-field drive method described above, there arises a problem that fast addressing operation is required because the addressing period AP becomes shorter than (one field period/n) by tens of percents in order to secure a light emitting period LP. The light emitting period LP is not secured if the addressing period AP is set to be equal to (one field period/n). For example, assuming that a total addressing period to a total light emitting period in one field is 1:1 and that n is 8 and one field period is 16 msec, an addressing period in each of the sub-fields must be shorter than 16 msec/2/8=1 msec.

SUMMARY OF THE INVENTION

The invention provides a display device of multiple gray levels corresponding to a predetermined number of bits of video data, which presents an image based on a field period comprising a predetermined number of sub-field periods of an equal duration. The device includes a plurality of pixels arranged in a matrix form, a pulse signal generation circuit that outputs pulse signals of a predetermined number that is equal to the predetermined number of bits of video data. Each of the pulse signals has a respective duration that is equal to or less than the equal duration of the sub-field periods. The device also includes a pulse signal selection circuit that selects one of the pulse signals for each of the sub-field periods and supplies the selected pulse signal to a corresponding pixel.

BRIEF DESCRIPTION OF THE DRAWINGS

FIGS. 5A and 5B are timing charts showing operation of the organic EL display device according to the embodiment of this invention.

FIG. 7 is for explanation of a method to reduce a peak current of a driver transistor in the organic EL display device according to the embodiment of this invention.

FIGS. 8A and 8B are for explanation on a generation mechanism of a false contouring in a sub-field drive method.

DETAILED DESCRIPTION OF THE INVENTION

Next, an organic EL display device according to an embodiment of this invention will be described hereafter referring to figures. First, a basic concept of this invention is explained referring to FIG. 1.

When $2^n$ levels of gray level display is performed with n bits of video data, one field is equally divided by n to generate a first sub-field through an n-th sub-field. Each sub-field has the same length of sub-field period as the other. And a line-sequential addressing is adopted in addressing pixels so that each line of video data is written in collectively. Addressing operation of the pixels and light emitting operation of the pixels are performed in parallel.

In addressing, each bit of the n bits of video data is assigned to each sub-field, and the video data for each bit is written into the pixels during each sub-field period. And in synchronization with the writing-in of the video data, pulse signals weighted with duty ratio (the ratio of the light emitting period to the sub-field period) are generated in each sub-field, and a light emitting element in each pixel emits light for a period corresponding to the duty ratio of the pulse signal corresponding to the video signal for the each bit. This enables the $2^n$ levels of gray level display while an addressing period AP for each sub-field is made (one field period)/n that is approximately equal to the sub-field period.

Figure 1:
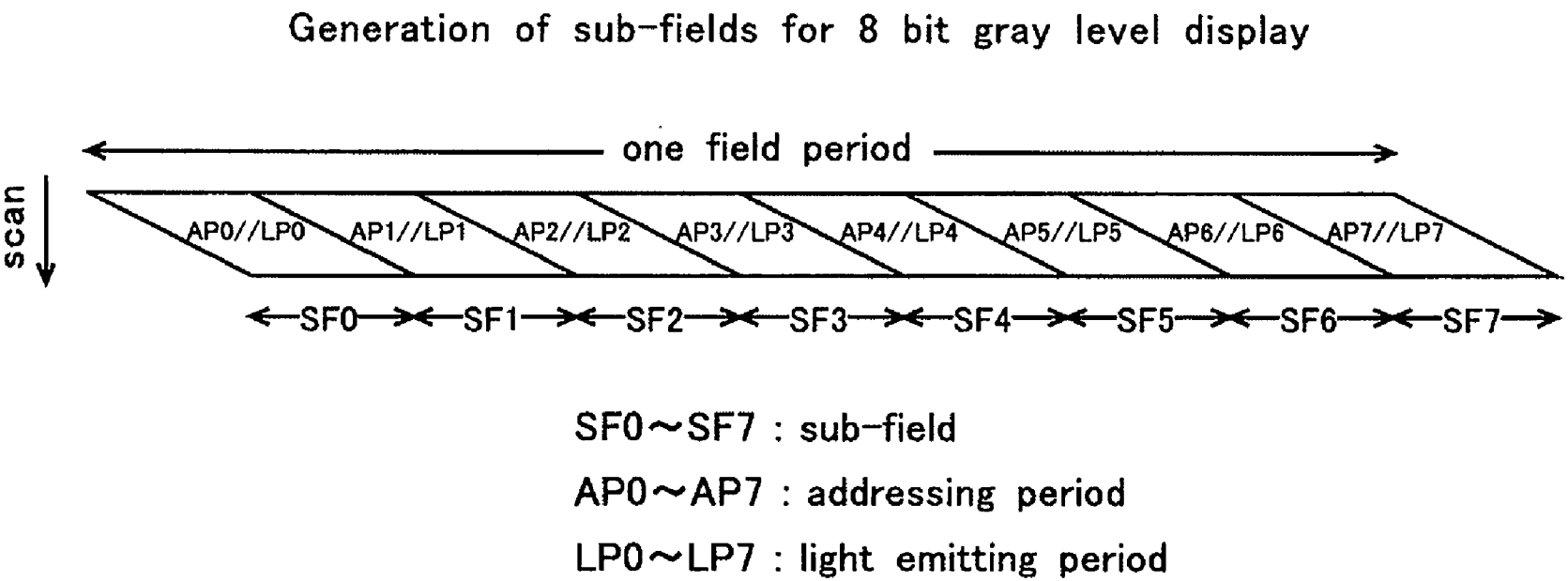
FIG. 1 shows a basic concept of this invention.

FIG. 1 shows an example in which sub-fields SF0-SF7 are generated for n=8, that is, 8 bits of gray levels. In this case, assuming that one field period is 16 msec, each addressing period AP is 16 msec/8=2 msec, making it possible to secure a longer addressing period compared with a conventional sub-field drive method. This enables reducing a rate of operation of a scan driver and a data driver, thus enables reducing power consumption in these circuits.

Figure 2:
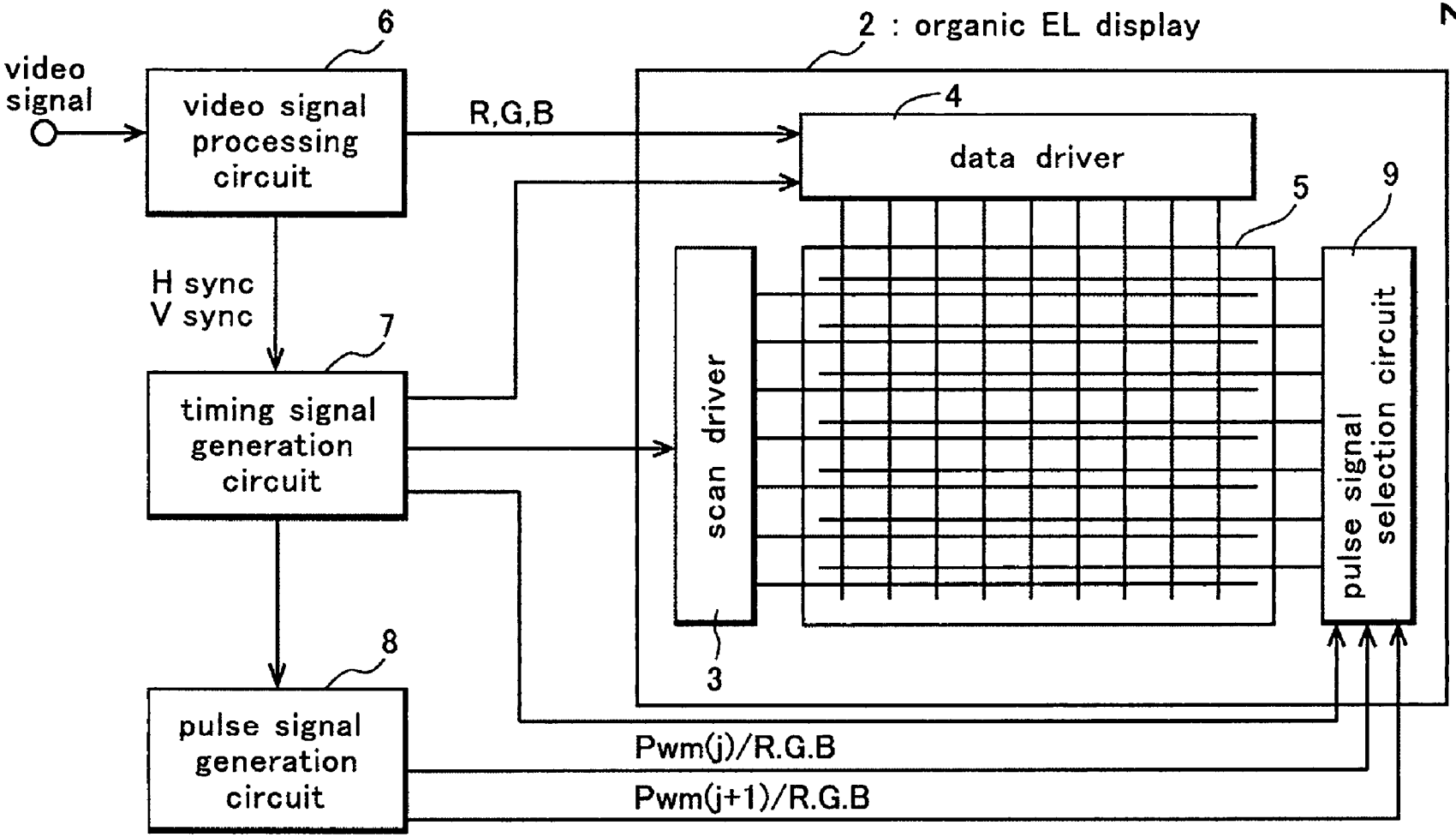
FIG. 2 is a circuit diagram showing an entire structure of an organic EL display device according to an embodiment of this invention.

Next, a concrete structure of the organic EL display device according to the embodiment is explained. This organic EL display device is formed by connecting a scan driver 3 and a data driver 4 to a display panel 5 including a plurality of pixels arrayed in a matrix form, as shown in FIG. 2. Video signals from an image source such as a TV receiver are fed to an image signal processing circuit 6 where signal processing required for displaying the image is performed. Resulting three primary color image signals R, G and B are fed to the data driver 4 in an organic EL display 2.

A horizontal synchronization signal Hsync and a vertical synchronization signal Vsync obtained in the image signal processing circuit 6 are fed to a timing signal generation circuit 7. A timing signal generated in the timing signal generation circuit 7 is fed to the scan driver 3 and the data driver 4.

The timing signal obtained from the timing signal generation circuit 7 is also fed to a pulse signal generation circuit 8 in which a pair of pulse width modulated pulse signals Pwm (j) and Pwm(j+1) is generated. Here, j is a natural number from one through (n−1). Although the pulse signals vary over time, only two pulses drive the pixels at a given point of time. There are total of n pulse signals Pwm(1 ) through Pwm(n). Each of the pulse signals Pwm(1 ) through Pwm(n) is assigned to each of the first sub-field through the n-th sub-field. A predetermined weight is assigned to a duty ratio of each of the n pulse signals Pwm(1 ) through Pwm(n) so that the gray level display is implemented.

That is, the light emitting period in each of the sub-fields is defined by the weight of the duty ratio. For example, the duty ratio of the pulse signals Pwm(1 ) through Pwm(n) is set to increases in geometric progression of 2. Not limited to that, it may be set in other ways, as will be described hereinafter. These pulse signals are fed to a pulse signal selection circuit 9 and a pulse signal is selectively outputted to pixels connected to a line of each of the sub-fields.

Figure 3:
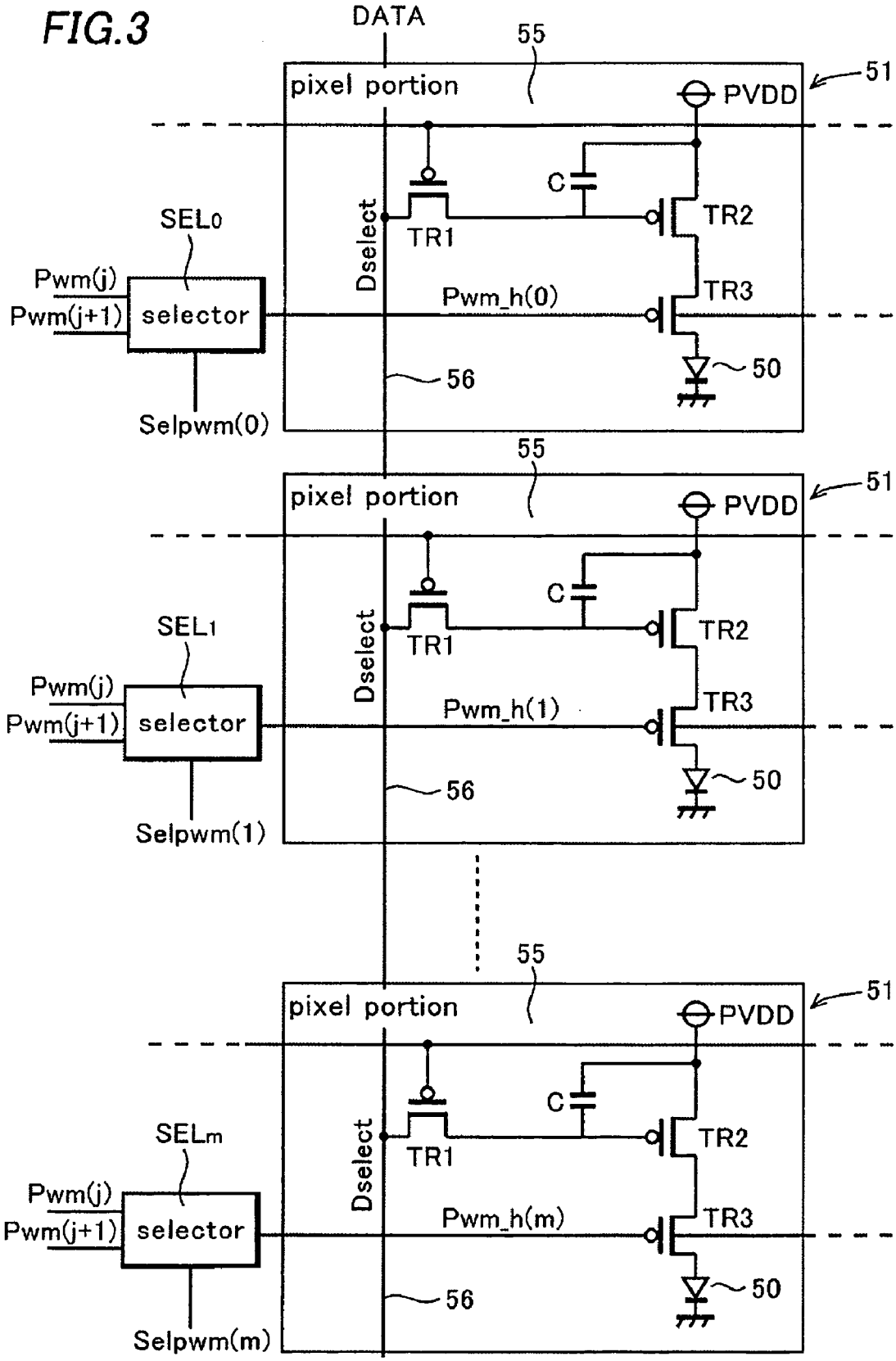
FIG. 3 is a circuit diagram showing a display panel of the organic EL display device according to the embodiment of this invention.

The display panel 5 includes pixels 51 arrayed in a matrix form. A column of the pixels 51 is shown in FIG. 3. Pixels of three primary colors R, G and B are arrayed adjacent to each other in a full-color organic EL display device. Although only one kind of pixel is explained in the following explanation, other kinds of pixels have the same structure.

An organic EL element 50 in each of the pixels 51 is formed of an organic luminescent layer. A write transistor TR1 is turned on when a scanning voltage from the scan driver 3 is applied to its gate through a gate line 55. Video data DATA from the data driver 4 goes through a data line 56 and the write transistor TR1 that is turned on, and is retained in a data retention capacitor C. A first driver transistor TR2 is provided with a power supply voltage PVDD, and is turned on depending on whether high or low of the binary video data that is retained in the data retention capacitor C and is applied to its gate.

A second driver transistor TR3 is connected in series with the first driver transistor TR2. The pulse signal selected by the pulse signal selection circuit 9 is applied to a gate of the second driver transistor TR3. The second drive transistor TR3 is turned on only for a period during which the pulse signal is high or low to provide the organic EL element 50 with a current from the first driver transistor TR2.

More specifically, a selector circuit SE0 in the pulse signal selector circuit 9 selects either Pwm(j) or Pwm(j+1) depending on a pulse selection timing signal Selpwm(0) and outputs a pulse signal Pwm_h(0). The pulse signal Pwm_h(0) is fed to the gate of the second driver transistor TR3 in the pixel 51 in a first row. Also, a selector circuit SEL1 in the pulse signal selector circuit 9 selects either Pwm(j) or Pwm(j+1) depending on a pulse selection timing signal Selpwm(1) and outputs a pulse signal Pwm_h(1). The pulse signal Pwm_h(1) is fed to the gate of the second driver transistor TR3 in the pixel 51 in a second row.

Other rows have similar structures. Regarding a last row, a selector circuit SELm in the pulse signal selector circuit 9 selects either Pwm(j) or Pwm(j+1) depending on a pulse selection timing signal Selpwm(m) and outputs a pulse signal Pwm_h(m). The pulse signal Pwm_h(m) is fed to the gate of the second driver transistor TR3 in the pixel 51 in the last row.

The data retention capacitor C shown in FIG. 3 may be replaced with an SRAM type retention circuit. The transistors TR1, TR2 and TR3 are P-channel type TFTs in the embodiment. However, the transistors may be N-channel type TFTs or a mixture of P-channel TFTs and N-channel TFTs.

Figure 4:
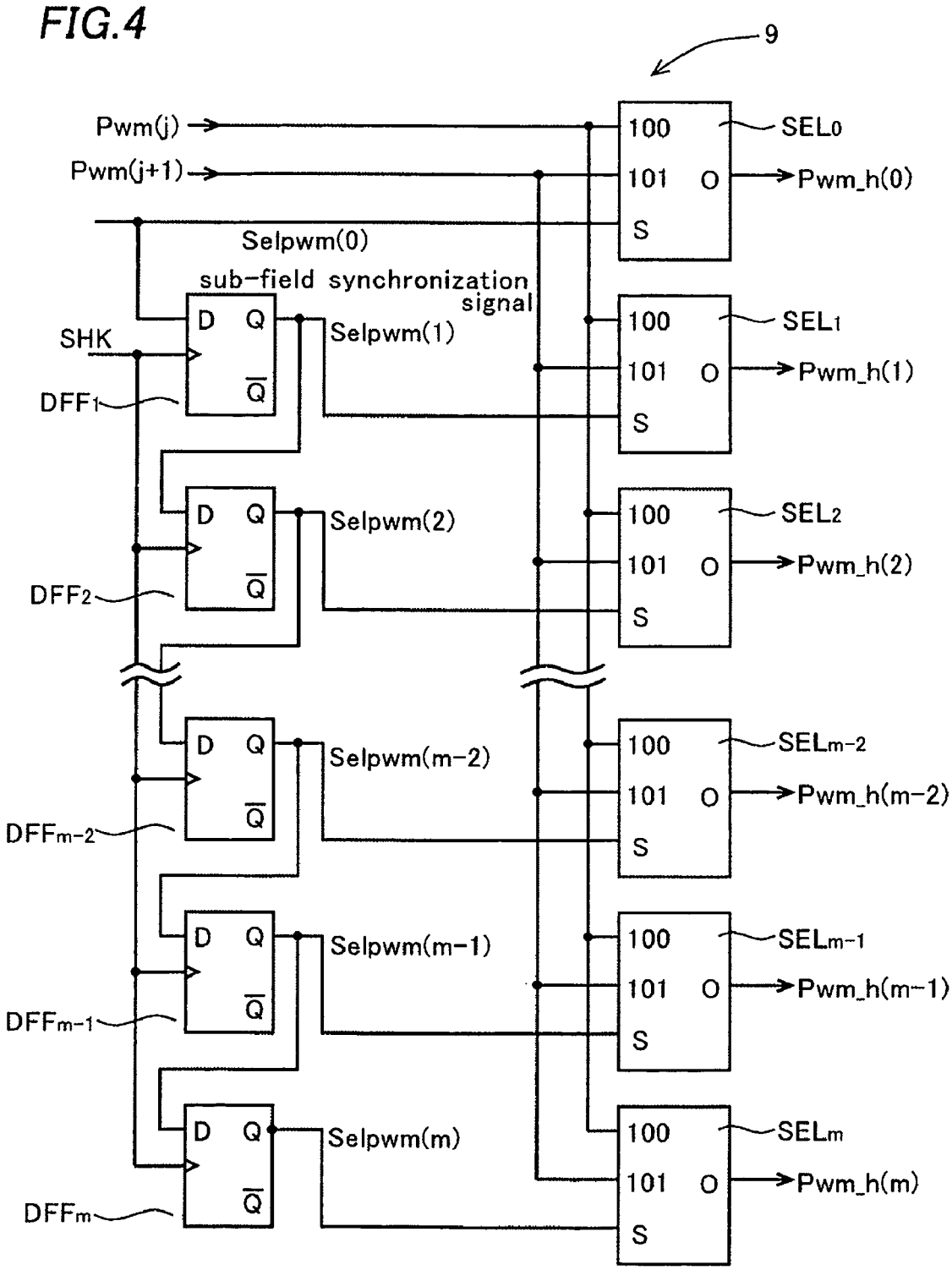
FIG. 4 is a circuit diagram showing a pulse signal selection circuit of the organic EL display device according to the embodiment of this invention.

FIG. 4 shows an overall structure of the pulse signal selection circuit 9. It has a plurality of delay flip flops DFF1 through DFFm that output pulse selection timing signals Selpwm(1) through Selpwm(m) by delaying a sub-field period signal Selpwm(0) that has a period of the sub-field period based on a sub-horizontal period clock SHK that is a horizontal period clock corresponding to the sub-field period and a plurality of selector circuits SEL0 through SELm that selectively outputs the pulse signals Pwm_h(0) through Pwm_h(m) corresponding to the pulse selection timing signals Selpwm(1) through Selppwm(m).

The selector circuits SEL0 through SELm are provide with Pwm(j) and Pwm(j+1) in common, and structured to select and output Pwm(j) when the pulse selection timing signals Selpwm(1) through Selpwm(m) are low or Pwm(j+1) when the pulse selection timing signals Selpwm(1) through Selpwm(m) are high.

Figure 6:
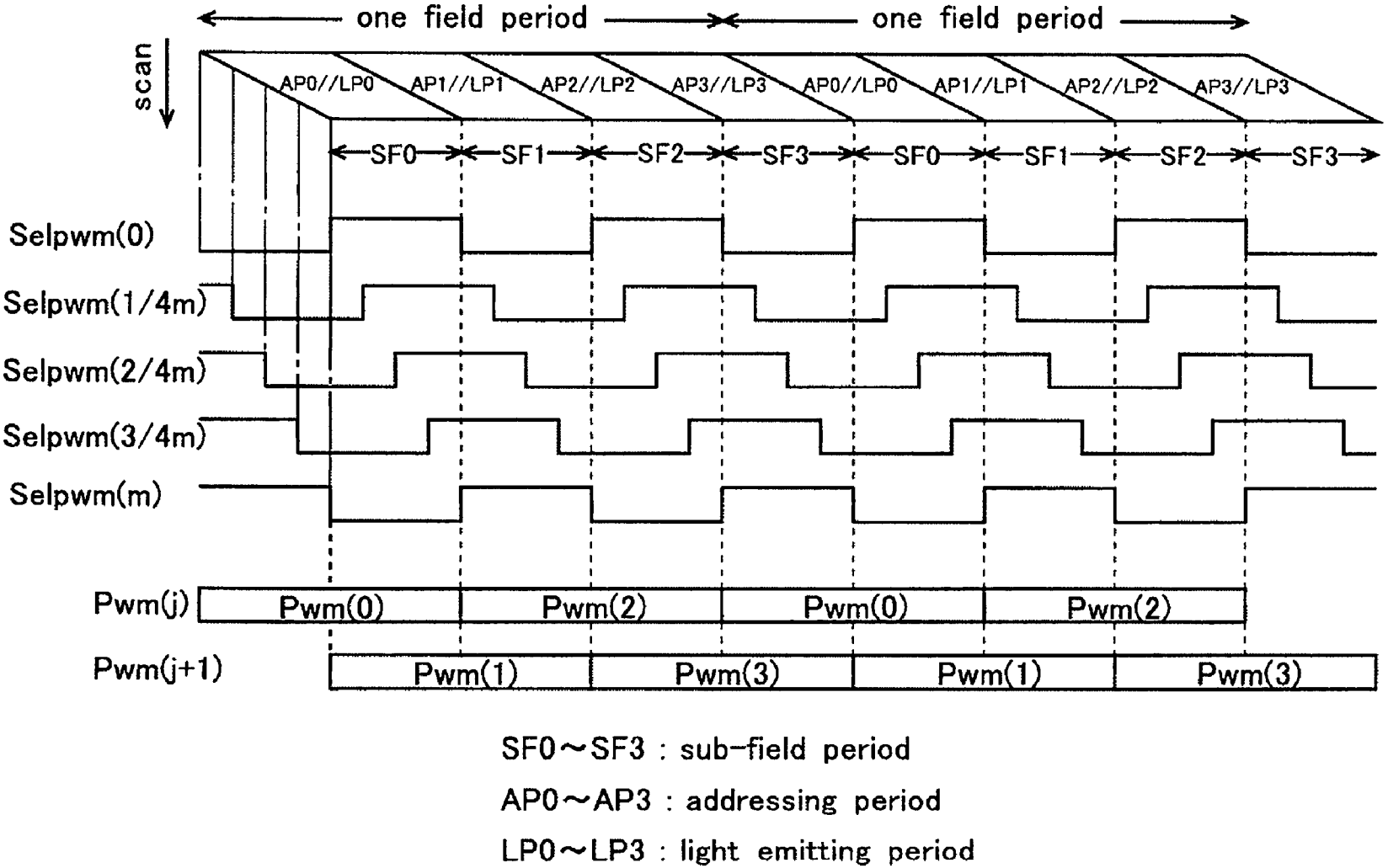
FIG. 6 is a timing chart showing the operation of the organic EL display device according to the embodiment of this invention.

Next, an operation of the organic EL display device described above is explained referring to timing charts shown in FIGS. 5A, 5B and 6. FIG. 5A shows correlation between a pulse signal Pwm_h(k) selected by the pulse signal selection circuit 9 and the sub-field period in a certain sub-field where the duty ratio of the pulse signal Pwm_h(k) is 50%, while FIG. 5B shows correlation between the pulse signal Pwm_h(k) and the sub-field in another sub-field where the duty ratio of the pulse signal Pwm_h(k) is 17%.

Since the addressing of the pixels 51 connected to each line is made line-sequentially, the sub-field period of each line shifts by a sub-horizontal period. The organic EL elements 50 are controlled to emit light or not to emit light depending on the written-in video data in parallel with the addressing.

A ratio of light emitting period to non light emitting period is common to lines when the lines belong to the same sub-field. For example, assuming that the pulse signal Pwm_h(k) is high in a light emitting period and the pulse signal Pwm_h(k) is low in a non light emitting period, the light emitting period and the non light emitting period are common in all the lines, as seen from FIGS. 5A and 5B.

FIG. 6 is a timing chart showing an operation of an organic EL display device that performs 16 levels of gray level display of 4 bit video data. One field is equally divided into four sub-fields that are a first sub-field SF0 through a fourth sub-field SF3. A first addressing period AP0 through a fourth addressing period AP3 and a first light emitting period LP0 through a fourth light emitting period LP3 are set corresponding to each of sub-field periods. The first addressing period AP0 through the fourth addressing period AP3 are approximately equal to periods of the first sub-field through the fourth sub-field SF3.

And the pulse signal generation circuit 8 generates pulse signals Pwm(0) through Pwm(3) having duty ratios each corresponding to each of the first sub-field SF0 through the fourth sub-fields SF3. Each of the light emitting periods LP0 through LP3 is defined by the duty ratio of each of the sub-fields, respectively.

The pulse signal generation circuit 8 outputs two of the pulse signals Pwm(0), Pwm(1), Pwm(2) and Pwm(3) at a time, each alternating in the order listed above with a time lag of one sub-field period, as shown in FIG. 6. Thus, there appear only two pulse signals at a given point of time. These pulse signals are selected in the pulse signal selection circuit 9 by the pulse selection timing signals Selpwm(1) through Selpwm(m) for each line, and the selected pulse signal is fed to gates of the second driver transistors TR3 in pixels connected to the line.

On the hand, addressing of the pixels is performed by the line-sequential addressing in which each line of video data is written in collectively. The data driver 4 assigns and outputs each bit of the 4 bit video data DATA to each of the first sub-field SF0 through the fourth sub-field SF3 in the order from the least significant bit to the most significant bit. Each bit of the video data DATA outputted from the data driver 4 is written into the pixels 51 through the write transistor TR1 in each of the sub-field periods.

With the organic EL display device of the embodiment, the addressing operation and the light emitting operation of the pixel 51 corresponding to each of the bit data and the pulse signal of each sub-field are performed in parallel to enable 16 levels of gray level display of the 4 bit video data DATA. Also, longer addressing periods AP0 through AP3 can be secured with the organic EL display device, in comparison to the conventional sub-field drive method. This enables reducing a rate of operation of the scan driver 3 and the data driver 4, thus enables reducing power consumption in these circuits.

Next, a structure to reduce a peak current of the organic EL element 50 in the organic EL display device of the embodiment described above will be explained. The light emitting period in each of the sub-fields is defined by the weight of the duty ratio of the pulse signal, as described above. In comparison of the organic EL display device of this embodiment using the sub-field drive method with the conventional organic EL display device using the analog drive method in which light is continuously emitted over one field period, the organic EL element 50 in the organic EL display device of this embodiment requires m/2 times of peak current to obtain the same emission brightness as in the conventional analog drive method when the weight of the duty ratio of the pulse signal increases in geometric progression of 2. Here m denotes a number of sub-fields, and a number of gray levels is $2^m$.

When $2^8$ gray levels are required, for example, the peak current (maximum current) required is 4 times of that in the conventional analog drive method. Increase in the peak current results in heating of the organic EL element 50, inviting a problem in reliability such as deterioration in characteristics of light emission brightness.

A method to reduce the peak current in the organic display device of this embodiment is explained taking an example in which $2^6$ gray levels are reproduced. FIG. 7 shows sub-fields and weight of the duty ratio of the pulse signal in each of the sub-fields. The duty ratio is equal to a ratio of a light emitting period to a sub-field period. FIG. 7 shows a case in which the duty ratio of the pulse signal increases in geometric progression of 2 and another case.

In the case in which the duty ratio of the pulse signal increases in geometric progression of 2, the duty ratio of the pulse signal in a highest sub-field (a sixth sub-field) is set to 100%. And when the duty ratios are summed up from a lowest sub-field (a first sub-field) to a sub-field just below the highest sub-field (fifth sub-field), the sum is close to 100%. (1+2+4+8+16=31) Since sub-fields equivalent to two sub-fields out of six sub-fields have duty ratios of about 100%, an emission brightness of the organic EL element 50 is reduced to ⅓ of that in the conventional analog drive method. Therefore, the peak current supplied to the organic EL element 50 must be increased to three times of that in the conventional analog drive method.

With this being the situation, the duty ratio of the pulse signal in a sub-field higher than the fifth sub-field is made equal to the duty ratio of the pulse signal in the fifth sub-field, while the duty ratio of the pulse signal in the fields from the first sub-field up to the fifth sub-field increases in geometric progression of 2. And the duty ratios in the fifth sub-field and in the sub-field higher than the fifth sub-field are set to 100%. Although six sub-fields should be enough to reproduce $2^6$ gray levels, a seventh sub-field SF7 is added in this case. There are three sub-fields SF5, SF6 and SF7 that have the duty ratio of 100%. And when the duty ratios are summed up from the first sub-field to the fourth sub-field, the sum is close to 100%. (1+2+4+8=15) Thus the peak current to secure the same emission brightness can be reduced to 7/4=1.75 times of that in the conventional analog drive method.

Next, a structure to suppress a false contour in the organic EL display device of the embodiment described above will be explained. First, a principle of occurrence of the false contour in the conventional sub-field drive method disclosed in Japanese Patent Publication Nos. 2003-241711 and 2002-278478 is explained, referring to FIGS. 8A and 8B.

Now it is assumed that generation order of six sub-fields SF0 through SF5 in terms of time is simply the same as the order of video data from the least significant bit (the first bit) to the most significant bit (the sixth bit) when 64 levels of gray level display is performed. It is also assumed that a border between a portion of a picture in which an image of 31 gray levels is displayed and a portion of a picture in which an image of 32 gray levels is displayed in a certain field moves in a direction 1 in FIG. 8A.

That is, pixels on the border display a picture of 32 gray levels in the certain field and are switched to display a picture of 31 gray levels in a next field. Because light emitting periods are concentrated in former sub-fields in the 31 levels of gray level display while the light emitting periods are concentrated in latter sub-fields in the 32 levels of gray level display in one field, the light emitting periods to display the 32 gray levels is immediately followed by the light emitting periods to display the 31 gray levels in the pixels on the border (Refer to FIG. 8B). As a result, the pixels look continuously emitting light for one field period to human eyes. The border is noticed as an unusually bright line on the screen.

It is assumed, on the contrary, that a border between a portion of a picture in which an image of 32 gray levels is displayed and a portion of a picture in which an image of 31 gray levels is displayed in a certain field moves in a direction 2 in FIG. 8A. Non light emitting periods to display the 31 gray levels is immediately followed by non light emitting periods to display the 32 gray levels in pixels on the border (Refer to FIG. 8B.). As a result, the pixels look continuously emitting no light for one field period to human eyes. The border is noticed as an unusually dark line on the screen.

Even in a still picture, since a viewpoint of a human moves subtly despite his intension to watch a point, there appears a display disturbance due to the same cause as in the moving picture that the viewer feels the border between the different gray levels swinging.

On the other hand, in the organic EL display device described above that uses the drive method in which one field is equally divided into a plurality of sub-fields, even if generation order of the plurality of sub-fields is simply the same as the order of video data that is from the least significant bit to the most significant bit, the occurrence of the false contour is suppressed because the occurrence of continuous long light emitting period or non light emitting period in one field period is suppressed compared with the conventional sub-field drive method.

Figure 9A:
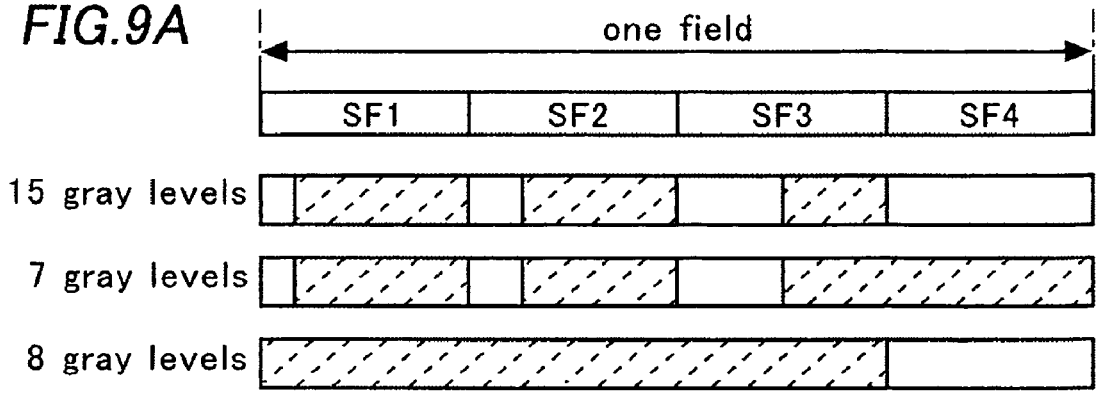
FIGS. 9A and 9B are for explanation on improvement in the false contouring by the organic EL display device according to the embodiment of this invention.
Figure 9B:
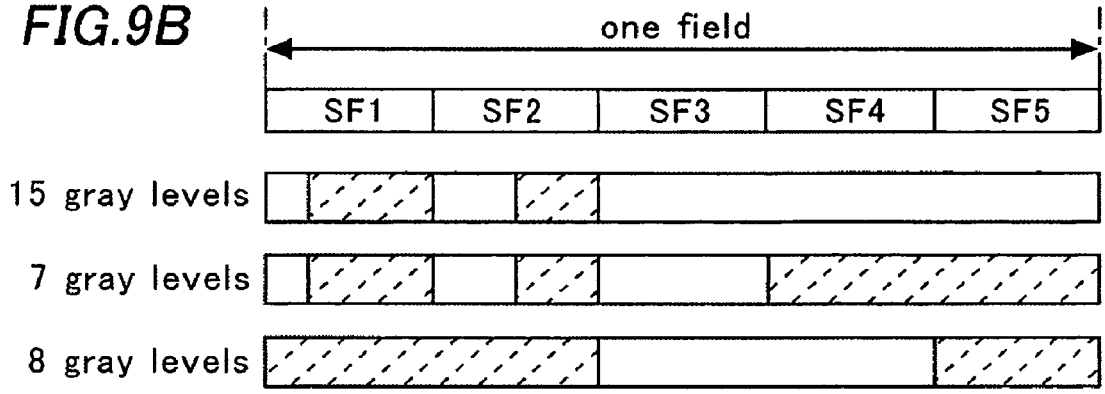

FIGS. 9A and 9B are figures to explain how the false contour is improved with the organic EL display device according to the embodiment. FIG. 9A shows light emitting periods and non light emitting periods when one field is divided into four sub-fields SF1 through SF4 and 16 levels of gray level display is performed with 4 bit video data DATA. White periods denote light emitting periods while black periods denote non light emitting periods. As seen from the figure, the light emitting periods and the non light emitting periods are dispersed over the sub-fields to ease the problem of the false contour.

Even so, however, non light emitting period lasts relatively long, when a picture transfers from 7 gray levels to 8 gray levels. In order to further improve the problem of the false contour, the non light emitting periods and the light emitting periods at change of the field must be suppressed as much as possible.

There are two effective methods for that purpose. A first method is to change the assignment of each bit of the video data DATA to each of the sub-fields so that the assignment is different in each field. For example, the generation order of the plurality of sub-fields is simply the same as the order of the video data that is from the least significant bit to the most significant bit in a certain field, and the least significant bit and the most significant bit are exchanged in the next field. The change of assignment is done in a decoder circuit (not shown) in the data driver 4.

A second method is to utilize the weight of the sub-field to reduce the peak current described above. That is, the duty ratio of the pulse signal is set in a way that the duty ratio increases in geometric progression of 2 from the first sub-field to an intermediate sub-field, and remains constant from the intermediate sub-field to the last n-th sub-field.

FIG. 9B shows an example of the organic EL display device to which the first and the second methods described above are applied. In the organic EL display device that displays 16 gray levels similar to the display device of FIG. 9A, a fifth sub-field SF5 is added and the weights assigned to the sub-fields SF1, SF2, SF3, SF4 and SF5 are 1:2:4:4:4. Also, the most significant bit (the first bit) and the least significant bit (the fourth bit) are alternated field by field. With these methods, duration of non light emitting period is shortened when the picture shifts from 7 gray levels to 8 gray levels, further improving the problem of false contour.

Figure 10:
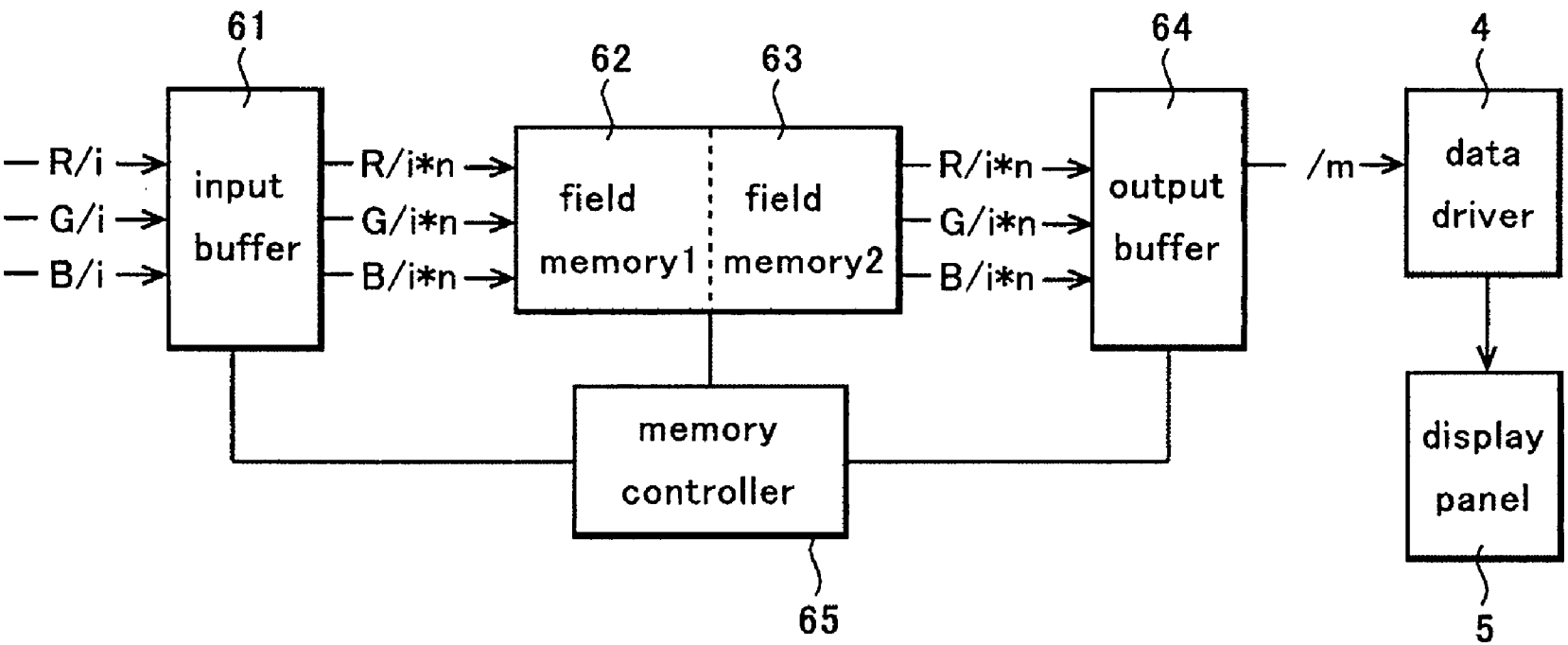
FIG. 10 is a block diagram for explanation on data transfer of the organic EL display device according to the embodiment of this invention.
Figure 11:
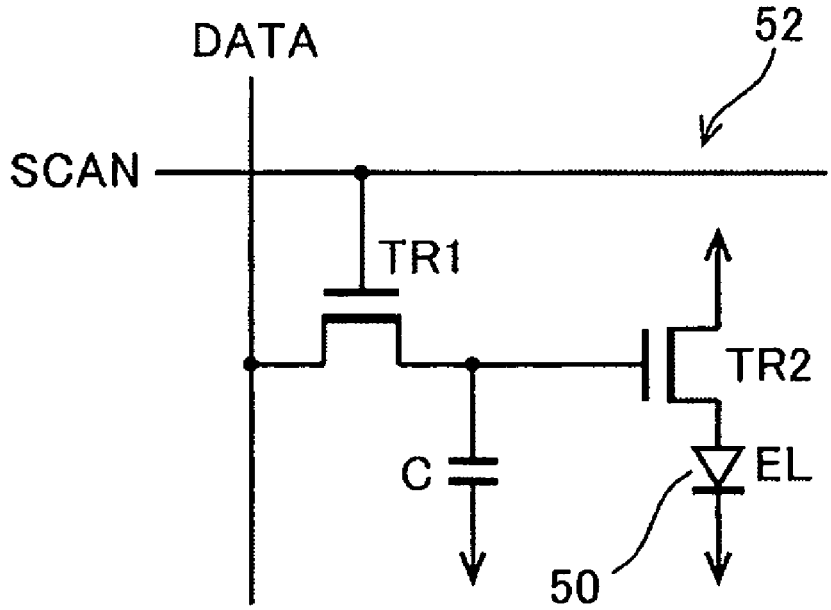
FIG.11 PRIOR ART
FIG. 11 is a circuit diagram of a pixel in an organic EL display device according to a prior art.
Figure 12:
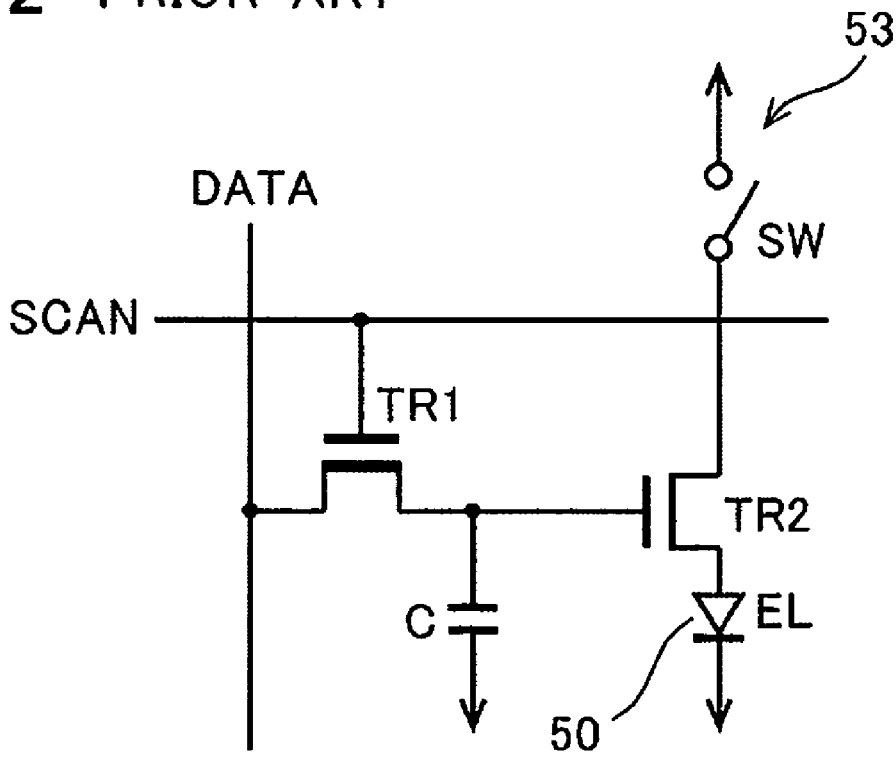
FIG.12 PRIOR ART
FIG. 12 is a circuit diagram of a pixel in the organic EL display device according to the prior art.
Figure 13:
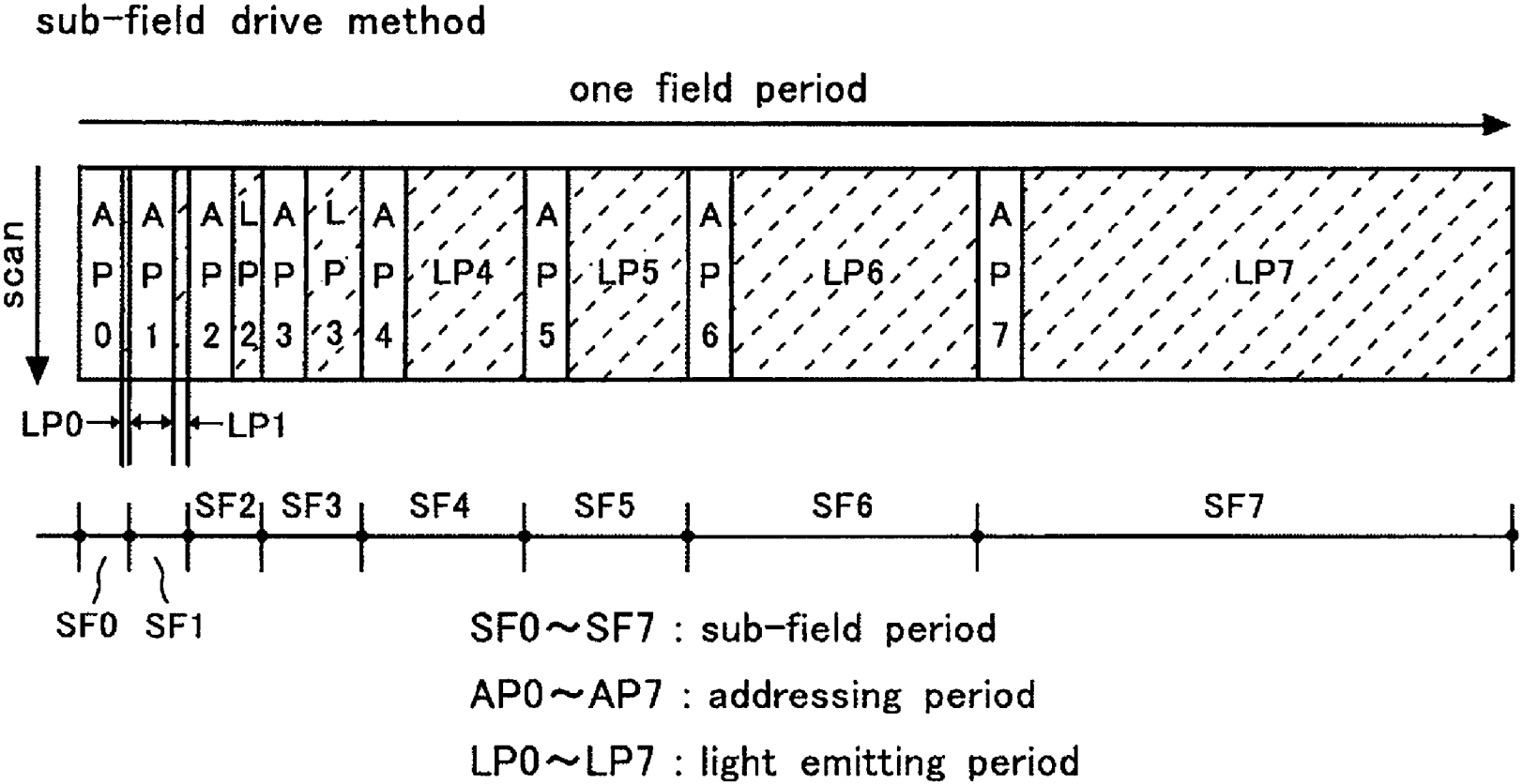
FIG. 13 PRIOR ART
FIG. 13 is for explanation of sub-field drive method according to the prior art.

FIG. 10 is a block diagram for explanation on data transfer of the organic EL display device according to the embodiment of this invention. Video data of RGB is supplied to a data driver (a horizontal scanner) 4 through an input buffer 62, a first field memory 62, a second field memory 63 and an output buffer 64. A flow of data is shown in this example assuming that each of the video data RGB has i bits and n times of data bus width and that a number of channels in data transfer is m.

The first field memory 62 and the second field memory 63 can retain video data of all pixels for one field. A memory controller 65 controls the first field memory 62 and the second field memory 63 alternating their usage so that one of the first and the second field memories 62 and 63 serves as a buffer memory for video data of next field while the other field memory serves as a display field memory. With this, a data transfer rate can be easily reduced in data transfer from a video signal source to a display panel 5 by increasing the data bus width.

According to the embodiments, variation in threshold voltages of driver transistors for light emitting elements has very little effect, since a digital drive method is adopted. Inconsistencies in display can be prevented with this.

Also according to the embodiments, longer addressing period can be secured compared with conventional drive method, since one field is divided by n to generate n sub-fields and addressing of pixels and light emitting operation of light emitting elements are performed in parallel. This enables reducing a rate of operation of a scan driver and a data driver, thus reducing power consumption in these circuits.

Furthermore, a phenomenon that an unnatural dark line of bright line appears on a display (false contour) is prevented, since one field is divided by n to generate n sub-fields and addressing of pixels and light emitting operation of light emitting elements are performed in parallel thus occurrence of continuous long light emitting period or non light emitting period is suppressed compared with conventional sub-field drive method.

Even further, a circuit to switch the sub-fields is simplified compared with the conventional sub-field drive method. There is an additional effect that a data transfer rate can be easily reduced in data transfer from a video signal source to a display panel by increasing the data bus width, because the video data is binary data.

What is claimed is:

1. A display device of multiple gray levels corresponding to a predetermined number of bits of video data, the display device presenting an image based on a field period comprising a predetermined number of sub-field periods of an equal duration, comprising:

a plurality of pixels arranged in a matrix form;

a pulse signal generation circuit that outputs, for light emission, pulse signals of a predetermined number that is equal to the predetermined number of bits of video data, each of the pulse signals having a respective duration that is equal to or less than the equal duration of the sub-field periods; and a pulse signal selection circuit that selects one of the pulse signals for each of the sub-field periods and supplies the selected pulse signal to a corresponding pixel, wherein the durations of the pulse signals correspond to the bits of the video signal so that at least one of the pulse signals has a duration less than the equal duration of the sub-field periods and at least three pulse signals have different durations.

2. The display device of claim 1, further comprising a scan driver and a data driver, wherein each of the pixels comprises a light emitting element, a write transistor that turns on when a scanning voltage from the scan driver is applied, and a driving circuit that provides the light emitting element with a current corresponding to the video data supplied from the data driver through the write transistor for a period determined by the duration of the pulse signal selected by the pulse signal selection circuit.

3. The display device of claim 2, wherein the driving circuit comprises a data retention element to retain the video data supplied from the data driver through the write transistor, a first driver transistor that is turned on corresponding to the video data retained by the data retention element and a second driver transistor that is turned on for the period determined by the duration of the pulse signal selected by the pulse signal selection circuit and provides the light emitting element with a current from the first driver transistor.

4. The display device of claim 2, wherein the predetermined number of the sub-field periods is equal to the predetermined number of bits of video data, and the data driver outputs each of the bits of video data in the order from a least significant bit to a most significant bit to a corresponding sub-field period in the order from a first sub-field period to a last sub-field period.

5. The display device of claim 2, wherein the predetermined number of the sub-field periods is equal to the predetermined number of bits of video data, and the data driver outputs each of the bits of video data in different orders in different field periods.

6. The display device of claim 1, wherein the durations of the pulse signals are determined by power of 2.

7. The display device of claim 1, wherein the durations of the pulse signals at a beginning of the field period are determined by power of 2 and the durations of the pulse signals before an end of the field period are constant.

8. The display device of claim 7, wherein the predetermined number of the sub-field periods is a sum of the predetermined number of bits of video data and a natural number.

9. The display device of claim 1, further comprising a first field memory and a second field memory each storing one field of the video data for all of the pixels and a control circuit that alternates roles of the first and second field memories so that one of the first and second field memories serves as a buffer memory for video data of a next field while another of the first and second field memories serves as a display field memory for video data of a current field.

10. The display device of claim 1, wherein the predetermined number of the sub-field periods is equal to the predetermined number of bits of video data.

11. The display device of claim 1, wherein the pixels of the matrix form are configured to be addressed while emitting light.

12. A display device of multiple gray levels corresponding to a predetermined number of bits of video data, the display device presenting an image based on a field period comprising a predetermined number of sub-field periods of an equal duration, comprising:

a plurality of pixels arranged in a matrix form;

a pulse signal generation circuit that outputs, for light emission, pulse signals of a predetermined number that is equal to the predetermined number of bits of video data, each of the pulse signals having a respective duration that is equal to or less than the equal duration of the sub-field periods; and a pulse signal selection circuit that selects one of the pulse signals for each of the sub-field periods and supplies the selected pulse signal to a corresponding pixel, wherein the durations of the pulse signals correspond to the bits of the video signal so that at least one of the pulse signals has a duration less than the equal duration of the sub-field periods, and the pulse signal selection circuit comprises a plurality of delay flip flops that output a plurality of pulse selection timing signals based on a sub-horizontal period clock that is a horizontal period clock corresponding to the sub-field periods by delaying a sub-field period signal that has the duration of the sub-field periods, and a plurality of selector circuits that select and output the pulse signals in response to the pulse selection timing signals.

13. The display device of claim 12, wherein the pulse generation circuit outputs two pulse signals simultaneously at a time, and the two pulse signals outputted simultaneously have different durations.

14. The display device of claim 13, wherein the pulse signal selection circuit selects one of the two pulse signals outputted simultaneously for a corresponding sub-field period.

15. A display device of multiple gray levels corresponding to a predetermined number of bits of video data, the display device presenting an image based on a field period comprising a predetermined number of sub-field periods of an equal duration, comprising:

a plurality of pixels arranged in a matrix form;

a pulse signal generation circuit that outputs, for light emission, pulse signals of a predetermined number that is equal to the predetermined number of bits of video data, each of the pulse signals having a respective duration that is equal to or less than the equal duration of the sub-field periods; and a pulse signal selection circuit that selects one of the pulse signals for each of the sub-field periods and supplies the selected pulse signal to a corresponding pixel, wherein the durations of the pulse signals correspond to the bits of the video signal so that at least one of the pulse signals has a duration less than the equal duration of the sub-field periods, and the pulse signal selection circuit comprises a selector circuit provided for each row of the matrix form and configured to receive only two of the pulse signals at a time for the selection of the pulse signal supplied to the pixel.

16. A display device of multiple gray levels corresponding to a predetermined number of bits of video data, the display device presenting an image based on a field period comprising a predetermined number of sub-field periods of an equal duration, comprising:

a plurality of pixels arranged in a matrix form;

a pulse signal generation circuit that outputs, for light emission, pulse signals of a predetermined number that is the predetermined number of bits of video data minus one, each of the pulse signals having a respective duration that is equal to or less than the equal duration of the sub-field periods; and a pulse signal selection circuit that selects one of the pulse signals for each of the sub-field periods and supplies the selected pulse signal to a corresponding pixel, wherein the durations of the pulse signals correspond to the bits of the video signal so that at least one of the pulse signals has a duration less than the equal duration of the sub-field periods and at least three pulse signals have different durations.

* * * * *